US005248967A

United States Patent [19]

Daneshfar

[11] Patent Number: 5,248,967

[45] Date of Patent: Sep. 28, 1993

[54] METHOD AND APPARATUS FOR MONITORING ELECTRICAL DEVICES

[76] Inventor: Marek Daneshfar, 32 Peregrine Grove, Heronswood Park, Spennels, Kidderminster, Worcestershire, England, DY10 4UH

[21] Appl. No.: 691,842

[22] Filed: Apr. 26, 1991

[51] Int. Cl.[5] ..... G08G 1/097

[52] U.S. Cl. ..... 340/931; 315/130; 340/642; 340/661; 361/110; 364/483

[58] Field of Search ..... 340/642, 931, 458, 945, 340/947, 953, 661, 664; 364/483; 307/11, 10.8; 315/130, 135; 361/110

[56] References Cited

U.S. PATENT DOCUMENTS

| | | | |
|---|---|---|---|
| 4,208,692 | 6/1980 | Rohr | 361/110 |
| 4,291,302 | 9/1981 | King et al. | 340/458 |
| 4,295,079 | 10/1981 | Otsuka et al. | 340/642 |
| 4,633,418 | 12/1986 | Bishop | 364/483 |
| 4,792,701 | 12/1988 | Olon et al. | 340/642 |
| 4,811,010 | 3/1989 | Lucas | 340/642 |
| 4,979,122 | 12/1990 | Davis et al. | 364/483 |
| 5,005,008 | 4/1991 | King | 364/483 |
| 5,144,282 | 9/1992 | Sutterlin et al. | 340/642 |

FOREIGN PATENT DOCUMENTS 2150372 6/1985 United Kingdom .

*Primary Examiner*—Brent A. Swarthout

*Attorney, Agent, or Firm*—Allen, Dyer, Doppelt, Franjola & Milbrath

[57] ABSTRACT

The condition of signal lamps (R1, R2) in a traffic light system is monitored by compiling a table of power consumption levels at different levels of applied voltage. The table is then used to adjust measured levels of power consumption at intervals during the service life of the traffic light system. A fault condition is signalled if the adjusted values differ by more than a predetermined amount.

20 Claims, 2 Drawing Sheets

METHOD AND APPARATUS FOR MONITORING ELECTRICAL DEVICES

BACKGROUND OF THE INVENTION

The present invention relates to an apparatus for monitoring a condition of a plurality of electrically energizable devices. The invention is applicable to the monitoring of conductive, capacitive and inductive electrical devices.

When an initial condition of an electrically energizable device or combination of devices changes to a faulty condition, an electrical power consumption of the electrically energizable device in the faulty condition usually differs from the electrical power consumption under corresponding conditions of the device in its initial condition. For example, in the case of a lightbulb, its power consumption will probably fall to zero if the filament of the bulb fails and a same operating voltage continues to be applied to the bulb. In the case of a number of light bulbs connected together in parallel with one another, the aggregate power consumption of the bulbs will fall by a relatively small amount if the filament of only one bulb fails. In the case of a transformer or other inductive device, its power consumption may increase if the condition of the device deteriorates and the same operating voltage continues to be applied to the device. In the case of an assembly comprising an electric motor and a device driven by that motor, failure or deterioration in the condition of the driven device may bring about either an increase or a decrease in the power consumption of the motor, depending upon the nature of the failure. Changes in conditions other than failures or deterioration of devices also affect the power consumption of electrically energizable devices. For example, a change in the temperature of a device may affect its power consumption.

It has been proposed that the condition of an electrically energizable device should be monitored by monitoring the current flow through the device. For example, there is disclosed in GR 2,150,372A a system for detecting failure of lamps in a traffic light. This specification proposes that a value representing the current flow through a group of lamps which are energized concurrently should be stored in a memory during one cycle of the traffic light's operation. A corresponding new value of current flow measured during the next cycle should be compared with the stored value. If these values agree within a predetermined tolerance, then the new value is substituted in the memory for the previously stored value. If there is no agreement within the predetermined tolerance, then an alarm is given. The published specification also explains that the lamps are dimmed for operation during hours of darkness by reducing the applied voltage by 30%. It is suggested that an indication of this voltage reduction should be compared with another memory value so that the corresponding variation in current through the lamps will be taken into account.

One of the problems which arises in monitoring electrically energizable devices is that the applied voltage can vary for reasons other than deliberate dimming of lamps and these variations are likely to be smaller than 30%. In a traffic light system where a group of devices is monitored by measuring the aggregate current flow through those devices, it is desirable for the monitoring system to be capable of distinguishing between a change in current flow which results from failure of one of the devices of the group and a change in current flow which results from a change in the applied voltage.

SUMMARY OF THE INVENTION

According to a first aspect of the present invention, there is provided a method of monitoring the condition of an electrically energizable device (or group of devices) wherein the device is energized by the application thereto of different levels of voltage in succession. The power consumption of the device for each energizing voltage level is measured while the device is in a known condition. A scaler corresponding to the ratio of the power consumption for the device at one energizing voltage level to the power consumption of the device at a preselected voltage level is stored for each of the energizing voltage levels. Although the power consumption of the device is referred to as being measured and used for computing the scaler, the current consumption could be substituted for the power consumption. These stored values represent the voltage/power signature of the device.

During operation of the device, the voltage level and power consumption applied to the device is initially measured and subsequently re-measured a number of selected times. The initial measured power consumption value is operated on by the scaler to compute an initial adjusted power consumption value. The level of power applied at each selected time to the device is operated on by the scaler for the given applied voltage level to determine adjusted power consumption values. These adjusted power consumption values are compared with the initial adjusted power consumption values to verify operation of the device. Alternately, the difference between the adjusted power consumption values and the initial adjusted power consumption value may be compared with a predetermined threshold value to verify operation of the device.

Typically, in the monitoring of a number of electrically energizable devices or group of such devices, the adjusted values for respective devices or group of devices will be verified in turn according to a predetermined cycle. The stored values or scalers representing the relationship between the power consumption levels of various voltage levels for each device at known times may be absolute values or relative values.

The method may be applied to the monitoring of each of a number of individual electrically energizable devices, to the monitoring of a number of groups of electrically energizable devices or to the monitoring of some individual devices and some groups of devices. In a case where the condition of a plurality of groups of devices is monitored, an individual device may he included in more than one of the groups.

According to a second aspect of the invention, there is provided an apparatus for monitoring the condition of one or more electrically energizable devices, the apparatus comprising voltagemeasuring means for providing a voltage level representing the voltage applied at a selected time to each device; power-measuring means for providing a power or current value representing the power consumption at the selected time of the device; means for computing a scaler at each voltage level, wherein the scaler is used to adjust power or current consumption values at selected times; a memory for storing the scalers at selected voltage levels; and a processor programmed to compute an adjusted power or current value by adjusting samples of power or current applied to the device with the stored scaler at the selected voltage level. The apparatus also includes means for computing an initial adjusted power or current consumption value by adjusting an initial measured power or current consumption with the scaler. The adjusted power or current is subtracted from the initial power or current. The difference between the initial adjusted power or current consumption value and the adjusted power or current consumption value is compared with a predetermined threshold value to verify operation.

Respective power-measuring means is preferably provided for each device or group of devices to be monitored. The power measuring means can then be arranged to cause a value representing the power consumption of the corresponding device or group to be continuously accessible. Thus, this value may be read at the selected times by the processor.

The value representing the power consumption may be a measure of the current flow through the device or group.

According to a third aspect of the invention, there is provided a method of monitoring the condition of an electrically energizable device or a group of such devices, wherein there is provided either continuously or intermittently a root mean squared (r.m.s.) value representing the current flow through the device or group of devices and wherein said value is verified by making a comparison with a reference value. The r.m.s. value may be a measure of the power consumption of the device or group.

Use of an r.m.s. value in the comparison avoids errors resulting from voltage spikes or other transient conditions which may arise, for example, from switching of circuits having capacitive and/or inductive components. Accordingly, a method in accordance with the third aspect of the invention can be used to achieve reliable monitoring of conductive, capacitive or inductive devices.

According to a fourth aspect of the invention, there is provided a method of monitoring the operation of a traffic light system comprising a plurality of vehicle detectors associated with converging roads at the road's intersection. Each vehicle detector is adapted to provide a signal indicating that a vehicle is present when a vehicle moves into proximity with the detector. The interval between a "vehicle present" signal from one of the detectors and a "vehicle present" signal from any of the other detectors is checked and an alarm signal is provided if the interval is greater than a selected time period.

According to a fifth aspect of the present invention, there is provided method of monitoring the operation of a traffic light system having red, amber and green lamps wherein the intervals between energization and de-energization of at least one of the amber lamps are compared with selected values.

According to a sixth aspect of the present invention, there is provided in a traffic light system, an assembly which includes a substantially flat panel and a plurality of circuit boards bearing circuit components. The boards are substantially parallel to each other, perpendicular to the panel and have their respective edges adjacent to one face of the panel with a plurality of conductive pins projecting from an opposite face of the panel. Each pin is connected electrically with one of the circuit boards, a connector body at said opposite face of the panel and one or more electrically conductive leads terminating in a further connector component. The further connector component operates in conjunction with the connector body and establishes connections between at least some of said pins and the lead.

Each of the foregoing aspects of the present invention may be used in conjunction with any other one or more of these six aspects, or may be used independently of the other aspects of the invention.

According to a further aspect of the invention, a method is provided for monitoring the condition of a device where an input is applied to the device. The input is varied so that one of its parameters has different values at different times. Respective reference values of a parameter of an output from the device are obtained. These respective reference values correspond to the different values of the input parameter. A scaler value representing the ratio between different output reference values is stored in a table according to the parameter of the input. During initial use of the device, or group of devices, an initial input value of the parameter is detected as well as an initial output value. The initial output value is adjusted by the stored scaler corresponding to the parameter of the initial input value to determine an adjusted output value. During subsequent use of the device, or group of devices, respective values representing the output parameter at each selected time are provided for each device, or group of devices, a number of selected times. Also provided at selected times are input values representing the input parameter at each selected time. Whenever the initial value representing the input parameter at a selected time differs from the input values, the stored scaler values for the device are used to adjust the value representing the output parameter at the selected time. By scaling the output parameters the device compensates for the difference between the initial input value and other input parameters. The adjusted value representing the output parameter is compared with the adjusted output value to verify operation. The difference between the adjusted values may be compared with a predetermined threshold value to inform operator of correct operation of the monitored device.

BRIEF DESCRIPTION OF THE DRAWINGS

Examples of methods embodying the invention and an example of the apparatus embodying the invention will now be described, with reference to the accompanying drawings wherein.

DESCRIPTION OF THE PREFERRED EMBODIMENTS

The traffic light system represented in the accompanying diagrams comprises a number of colored incandescent filament lamps, including red amber and green lamps. Typically, a traffic light system at one road junction may comprise forty or more incandescent filament lamps. At least some of these lamps are connected together in groups, the lamps within a group being energized concurrently. By way of example, lamps R1 and R2 are connected in a first group, lamps A1 and A2 are connected in a second group and lamps G1 and G2 are connected in a third group. The installation may include certain lamps which can be energized individually. Such lamps are represented in the diagram at R3, A3 and G3. The traffic light system further comprises sequence controller 10 which is capable of energizing individual lamps and groups of lamps at the required time from a mains supply. Such controllers are known and therefore controller 10 will not be described in detail. Lamps R1 to R3, A1 to A3 and G1 to G3 may be fed through transformers which supply power at 12 volts to the individual lamps. For the sake of simplicity, the transformers are omitted from the accompanying figures.

Figure 1:
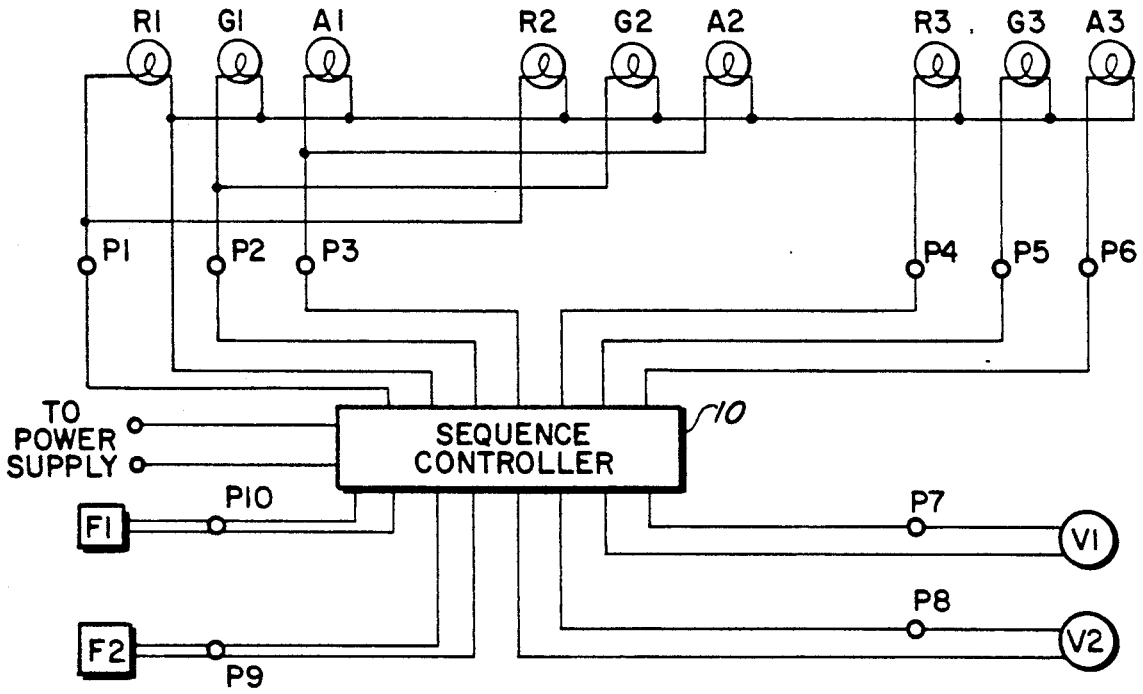
FIG. 1 is a diagram which represents a part of a circuit which embodies the invention for monitoring a road traffic light system.

The traffic light system further comprises a number of electrically energizable vehicle detectors such as inductive loops buried in the roads. As an example, two vehicle detectors are represented in FIG. 1 at V1 and V2. Although only two detectors are shown, a typical traffic light system may include a larger number of vehicle detectors, at least one detector for each road in a traffic intersection. The vehicle detectors may be connected together in a single group and energized continuously.

The traffic light system represented in FIG. 1 also comprises a number of fluorescent lamps, each with its associated control gear. Two lamps and associated control gear are depicted at F1 and F2. These lamps may be individually energized by sequence controller.

There is associated with each group of electrically energizable devices and with each individually energizable device a respective power measuring means $P_1$–$P_N$. Each power measuring means may comprise a respective toroidal transformer or a Hall-effect device, together with appropriate circuit components to provide a digital output representing the root mean square value of the power consumption of the group of devices or individual device concerned. Preferably this output signal is continuously available from the power measuring means and is up-dated many times per second.

Figure 2:
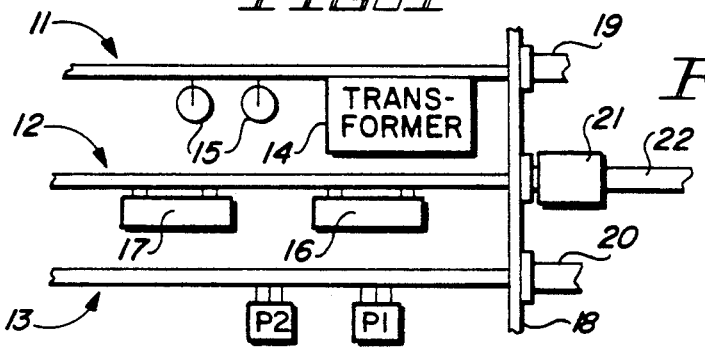
FIG. 2 is a diagrammatic representation of an assembly of the invention for monitoring the traffic light system.

Sequence controller 10 is mounted in a cabinet (not shown) in the proximity of the junction. As shown in FIG. 2, also mounted in the cabinet is a number of printed circuit boards, including power-supply circuit board 11, processor circuit board 12 and power measuring means circuit board 13. Circuit board 11 includes transformer 14 and other components for providing a suitable power supply to electronic components of the traffic light system from a 240 volts AC mains supply. Also associated with circuit board 11 is battery of cells 15 for providing a back-up power supply, in the event of the failure of the mains supply. Circuit board 12 contains processor 16 and associated integrated circuits, including memory 17, such as random access memory. Power-measuring means circuit board 13 contains individual power-measuring means $P_1$–$P_N$.

Circuit boards 11, 12 and 13 are mounted parallel to each other with one edge of each board immediately adjacent to one face of substantially flat panel 18. Holders (not shown) are provided for holding the circuit boards in a known manner so that each board can be slid away from panel 18 for inspection or replacement. For each of circuit boards 11, 12 or 13, a group of electrically conductive pins 19 project from the opposite face of panel 18 and connect with circuit components on the corresponding board. A respective connector body 20 of electric insulating material provided for each group of pins 19. Pins 19 project through respective openings in the connector body 20. Each connector body 20 receives a number of connector components 21 which are terminated on leads 22. Leads 22 provide electrical connections with other components 21 of the traffic light system (for example, sequence controller 11) and provide connections between circuit boards 11, 12 and 13. Suitable connector components 21 are supplied by 3MI United Kingdom Plc. under the designation Modular Backpanel System.

Pins 19 extend through apertures in panel 18 into hollow end portions of circuit boards 11, 12 and 13. The hollow end portions receive corresponding electrically conductive pins 19 mounted on circuit boards 11, 12 and 13 in a known manner. Pins 19 On circuit boards 11, 12 and 13 can be Withdrawn from hollow end portions when a circuit board is withdrawn for inspection or replacement. Connector bodies 20 may have markings and/or formations which assist with the identification of certain groups of pins 19 and to facilitate application of further connector components 21, in the required position to establish electrical connection between specific conductors in leads 22 and selected conductors on a circuit board. For example, connections with several phases of a traffic light system installation may be made by means of connector components, applied in respective predetermined positions to an appropriate connector bodies 20. The position on connector body 20 allocated to each phase would be the same as in other traffic light system installations having corresponding equipment.

Figure 3:
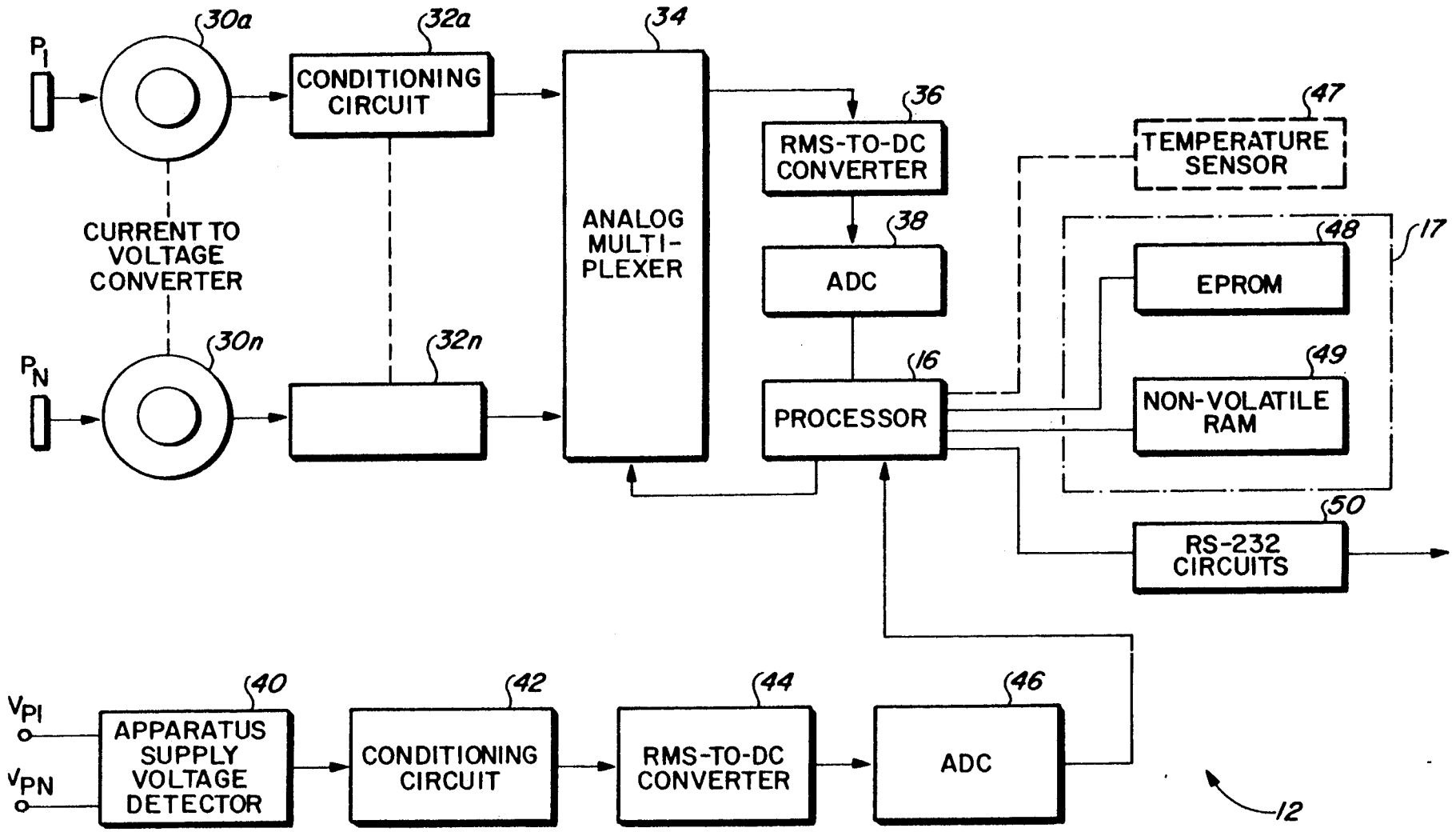
FIG. 3 is a simplified schematic diagram of the circuit which embodies the invention.

Referring to FIG. 3 there is shown a block diagram of the power monitor circuitry. This power monitor circuitry includes one or more current-to-voltage convertors 30(*a–n*) which sample the current being provided to the device being monitored, i.e. a traffic light system on $P_1$–$P_N$. Current-to-voltage convertors 30(*a–n*) then convert the current being provided to the device to a voltage level. The output of current-to-voltage convertors 30(*a–n*) are coupled to a conditioning circuit 32(*a–n*), respectively. The number of current-to-voltage convertors 30(*a–n*) and conditioning circuits 32(*a–n*) will correspond to the number of electronic devices to be monitored. Conditioning circuits 32(*a–n*) filter the signals from the current-to-voltage convertors 30(*a–n*). Further, these conditioning circuits 32(*a–n*) will amplify any weak signals being fed from current-to-voltage convertors 30(*a–n*). The output of these conditioning circuits 32(*a–n*) are fed to analog multiplexer 34 which time division multiplexes the signals fed from conditioning circuits 32(*a–n*).

Analog multiplexer 34 is controlled by processor 16. The output of analog multiplexer 34 is fed through Root Means Squaredto-Direct Current (RMS-to-DC) convertor 36 and Analog-to-Digital Convertor (ADC) 38 to processor 16. RMS-to-DC convertor 36 performs a root means square function to the analog signal being fed from analog multiplexer 34 to average the analog signal. This averaging provides a more accurate indication of the current level. Analog-to-digital convertor 38 converts the analog DC signal to a digital signal that can be read by processor 16. Microprocessor 16 preferably samples each analog channel for at least 100 microseconds.

In addition to the current-to-voltage convertors 30(*a-n*) being coupled to the device being monitored, one or more voltage detectors 40 are also coupled to the device being monitored. Voltage detector 40 samples the voltage level being supplied to the device ($V_{P1}$-$V_{PN}$) at selected times. The output of the voltage detector 40 is fed to conditioning circuit 42 which filters the signal from detector 40 to remove noise on the signal from voltage detector 40. Conditioning circuit 42 output is fed to RMS-to-DC convertor 44.

RMS-to-DC convertor 44 converts the signal from conditioning circuit 42 into a root means square value to provide an average voltage level indication. The output of the RMS-to-DC convertor 44 is fed through Analog-to-Digital Convertor (ADC) 46 to processor 16. Analog-to-digital convertor 46 converts the RMS signal to a digital level that can be read by processor 16.

Processor 16 is also coupled to temperature sensor 47. Sensor 47 detects the temperature adjacent the device to be monitored and feeds a digital signal corresponding to that temperature level to processor 16. Temperature sensors 47 are well known in the art. Although a temperature sensor is shown, other types of sensors can be used such as pressure sensor, humidity sensors, etc.

Processor 16, in addition to being coupled to analog-to-digital convertor 38 and analog-to-digital convertor 46 is electrically coupled to memory 17 which includes EPROM 48 and nonvolatile RAM 49. An RS-232 interface circuit 50 is coupled to processor 16 to permit communication with an external terminal (not shown).

EPROM 48 holds the scaler table containing the signature of the devices to be monitored. Further, EPROM 48 holds the program that runs processor 16. Nonvolatile RAM 49 is used by processor 16 to store sampled voltage levels and sampled current levels applied to the device being monitored.

Processor 16 communicates to external monitors or computers through RS-232 circuit 50. RS-232 circuit 50 provides drivers and receivers from processor 16. Further, RS-232 circuit 50 provides an interface for processor 16 to communicate with a terminal that can be used to set up and select parameters with processor 16.

Figure 4A:
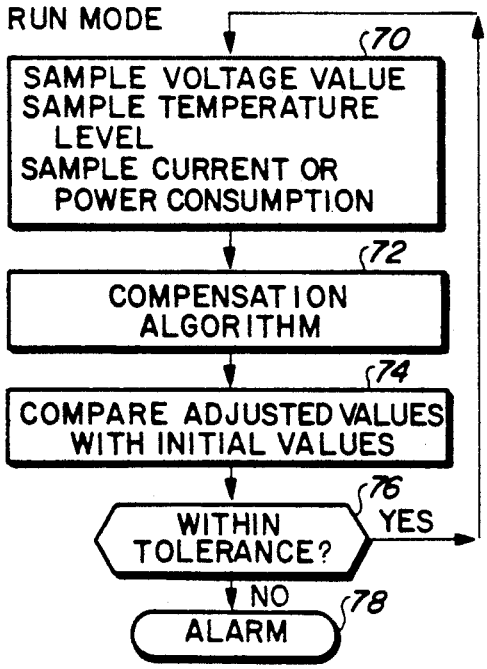
FIG. 4*a* is a flow diagram of the program which is executed by the processor during run-mode operation.
Figure 4B:
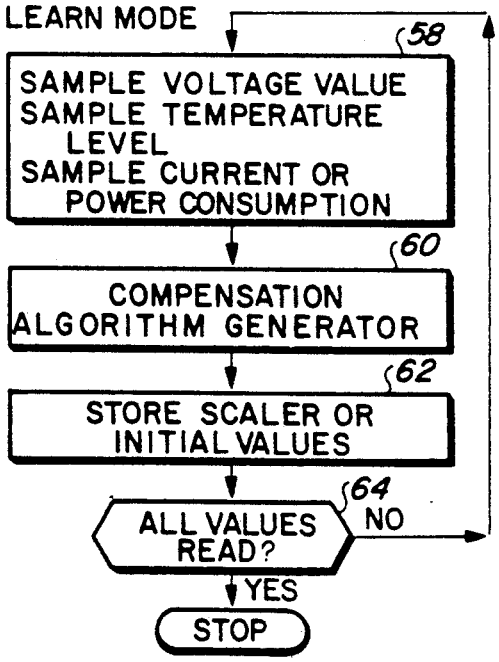
FIG. 4*b* is a flow diagram of the program which is executed by the processor during learn-mode operation.

Referring to FIGS. 4*a* and 4*b* there is shown a flow diagram of the program used by processor 16 to monitor the device. FIG. 4*a* is a flow diagram of the algorithm used by processor 16 during initialization of the power monitor, i.e. learn mode. The algorithm shown in FIG. 4*a* is preferably executed under laboratory conditions. FIG. 4*b* is a flow chart of the algorithm or process for monitoring the device while the device is running, i.e. run mode.

Referring to FIG. 4*a*, processor 16 will first execute step 58 by sampling the current (or power) value and the voltage value of the device being monitored. Processor 16 may also sample sensor 47. The current value is sampled by processor 16 reading a value off of analog-to-digital convertor 38, and the voltage value is sampled by processor 16 reading a value off of analog-to-digital convertor 46. Although a current value is being read by processor 16, processor 16 may calculate the power consumption of the device by multiplying the current being read by the impedance of the device as $P = IR$, where I is the current and R is the resistance, or impedance.

Once processor 16 samples the current value and voltage value in step 58, processor 16 executes step 60 by creating a scaler by dividing one of the sampled current values by a reference sampled current value. This reference current value is preferably the current value for the device while operating at its typical voltage level.

For example, processor 16 executes step 58 by reading a sampled voltage value applied to the device, i.e. 240 volts, and then sampling the current value applied to the device, i.e. 100 millilamps. Processor 16 would then sample temperature sensor 47. Processor 16 then samples another voltage level applied to the device, i.e. 230, another current value applied to the device, i.e. 104 milliamps and temperature level.

Processor 16 then executes a compensation algorithm in step 60 by dividing the 104 milliamps current value by the 100 milliamps to obtain a scaler of 1.04. The scaler corresponding to the 230 sample voltage level, i.e. 1.04, is then stored in EPROM at a first memory location corresponding to 230 volts. Storing the scalers at the different voltage levels results in a scaler table being compiled. The process will then be repeated by sampling the current value applied to the device at the next voltage value, i.e. 231 volts. The current value for that voltage will also be divided by 100 milliamps and stored as a scaler at a second memory location corresponding to the 231 volt value. The scaler for 240 volts in this example would be 1.0.

The scalers are stored in memory 17 in step 62. After each scaler is stored, processor 16 then executes a check to determine if all the voltage and current (or power consumption) values have been read in step 64. If all the voltage and respective current (or power consumption) values have been read, the room temperature could be increased by a predetermined amount and another scaler table would be compiled. Once the current or power consumption values for the entire temperature range have been determined, and the scaler tables compiled, processor 16 will stop and wait for run-mode operation to begin. If all the voltage and power consumption values have not been read, processor 16 then jumps to step 58 where the next sample current value and sample voltage values are read. Although processor 16 computes and stores a scaler, which is used during run-mode operation, processor 16 could also save the actual temperature, current values, power consumption values or power supply voltage values, and then re-create the scaler during run mode.

Processor 16 will also execute the steps in the learn mode (FIG. 4*b*) upon initialization of the device in the field to set a baseline or signature for device operation. For example, when the device is initialized the device reads the sampled current or power consumption value, the sampled voltage value and optimally, the temperature level, in step 58 of the device. The device then executes step 60 where it runs the compensation algorithm, in which the sampled current value is multiplied by the scaler for the sampled voltage value and temperature level in memory 17, thereby determining an initial adjusted power consumption value. This initial adjusted power consumption value is compared during runmode mode to verify monitor operation. This initial power consumption value is stored in memory 17 in step 62 and then waits until runmode is to begin.

As an example, processor 16 reads an initial sample voltage value in the field of 230 volts and an initial current value of 192 milliamps. Processor 16 may also read an initial temperature level. The initial current value will be multiplied by the scaler in memory at 230 volts, i.e. 1.04, to obtain an adjusted initial current value, i.e. 200 milliamps. The adjusted initial current value is stored in RAM 49 and compared during run mode.

Referring to FIG. 4*b*, during run-mode processor 16 samples the voltage value, temperature level and the current or power consumption value applied to the device during step 70 at selected time intervals. For example, assume that the sampled voltage value applied to the device during operation has 240 volts and the sample current applied to the device during operation has 200 milliamps. Processor 16 then executes step 72 where it executes the compensation algorithm.

In this compensation algorithm step 72, processor 16 multiplies the sampled current or power consumption value, i.e. 200 milliamps, by the scaler (i.e. 1.0 for 240 volts) in memory 17 corresponding to the sampled voltage value and temperature level to obtain an adjusted sample power or current consumption value (i.e. $1.0 \times 200$ milliamps $=200$ milliamps). Processor 16 then executes step 74 where this adjusted current or power consumption value is compared with the initial adjusted current or power consumption value. Processor 16 then executes step 76.

In step 76 processor 16 compares the adjusted power consumption value (200 milliamps) with the initial adjusted power consumption value (200 milliamps) to determine if they are within a predetermined tolerance. The tolerance may be a percentage or may be a specific number set by the user when initializing processor 16. If these voltages are within tolerance, as they are in this example, processor 16 will then sample the device or another device by executing step 70. If the initial adjusted power consumption value and the adjusted sampled power consumption or current value are not within tolerance, processor 16 executes step 78.

In process step 78, processor 16 executes an alarm where it provides a signal to the operator that one of the devices is not working correctly.

Prior to use of the installation, each of the groups of electrically energizable devices or each of the individual electrically energizable devices (being in normal working order) is energized by the successive application thereto of different predetermined voltage levels at different temperature levels.

These predetermined voltage levels may correspond, for example, to voltages which may differ by steps of 1 volt. For example, one such predetermined voltage level is a series of voltage levels descending from 250 volts to 230 volts in steps of 1 volt.

During energization of each group of devices or individual device at each voltage level, the corresponding power-measuring means is used to provide a digital signal representing a magnitude of the power consumption of the group or device. Sampled signals representing the applied voltage level and representing the power consumption are passed to processor 16. Processor 16 converts the signals representing the power consumption into a scaler by dividing the magnitude of the power consumption at each corresponding voltage level and temperature level by the magnitude of the power consumption at one of the voltage levels.

Processor 16 stores these scalers in memory 17 in a location corresponding to each corresponding voltage level. Storing these scalers by voltage level and temperature level results in a table of the signatures for each of the groups of devices and each of the individually energized devices. A separate signature table could be established in memory 17 for each device to be monitored. Further, a separate table could be created for each device while generating at different temperatures, pressures, humidities, etc. For example, a scaler table could be created at 230 volts for temperatures from $-10°$ F. to 90° F., and then separate scaler tables could be created at 231, 232 . . . 250 volts for temperatures in the same temperature range. Establishment of the table is a preparatory step in commissioning of the traffic light system. Once the table has been established in part of memory 17, this part of memory 17 is protected against overwriting of the stored information. Provision may be made for this protection to be removed, for example, by the connection of an extraneous processor or other electronic device to the equipment incorporated in a traffic light system installation.

When the traffic light system is first brought into use, processor 16 initially samples the power or current consumption and the applied voltage level at an initial temperature level for each group of devices and for each individually energized device, while that group or device is in known working order or operating condition. The aforementioned temperatures, pressure, etc. could also be sampled. Processor 16 adjusts the value of the power consumption by multiplying the power consumption value by the scaler in memory 17 for the device being monitored at the location of the applied voltage level and optionally the proper temperature level. This initial adjusted power consumption value is stored in the memory.

During each succeeding cycle of operation of the traffic light system, the signal provided by power-measuring means $P_1$ to represent the power consumption of the group of devices R1, R2 is sampled at one or more selected times, and the voltage level applied to the group of devices R1, R2 and temperature level is sampled at the same time or times. The value of the sample power consumption is adjusted by multiplying the value by a corresponding scaler in memory corresponding to the location of the applied voltage level and optionally the proper temperature level. The adjusted power consumption is compared with the initial adjusted power consumption value for the group R1, R2. If the adjusted sample power consumption value is found to be the same as the initial adjusted power consumption value within a predetermined tolerance, for example 3%, then the system accepts that devices R1 and R2 are in normal working order.

If there is no agreement within the predetermined tolerance, then processor 16 carries out steps appropriate to a fault condition. These may include taking further samples of the values representing the applied voltage level and the power consumption of devices R1, R2, and adjusting them to check that a fault condition exists, and providing an alarm signal. The alarm signal may be transmitted to a remote station. Additionally, the alarm signal may be used to energize one or more indicators at the junction.

Circuit board 11 contains means for monitoring the supply voltage from a main power supply (not shown) and or should power supply fall, switching-in the stand-by battery to power processor 16. Circuit board 1 also contains means to prevent the supply of power from the battery to other devices which are not required to function, in the event of failure of the power supply. Processor 16 responds to failure of the power supply by transmitting an appropriate alarm signal to the remote station.

A sample of the power consumption of each group of devices and of each individually energized device is measured at respective selected times and then verified in a corresponding way.

Upon the traffic light system first being brought into use, processor 16 samples the power consumed by one or more amber lamps and identifies the longer period during which the lamp or lamps is energized. This longer period is used as a reference point in the cycle of operation of the traffic light system. During the installation of the traffic light system, information describing a complete cycle is supplied to processor 16 and stored in its memory 17. Processor 16 is then able to sample the power consumption value of each lamp or group of lamps one second after that lamp or group of lamps has been energized. The power consumption may be sampled at intervals of one tenth of a second over a period of about one half second. An average of the applied voltage level and power consumption value of the lamp or group of lamps through this period may be adjusted and used for comparison with the subsequent adjusted voltage level and power consumption values.

Processor 16 may also compute the ratio of the instantaneous power consumption of each lamp or group to a predetermined reference value of the power consumption for that lamp or group. This predetermined reference value may be obtained during factory testing of the device to be monitored. This ratio is computed at intervals and the last computed value is stored. When the ratio is again computed, the computed value is compared with the stored reference power consumption value. If the difference exceeds a predetermined proportion, then processor 16 takes steps appropriate to a fault condition. However, if the difference is below a predetermined threshold, then the system assumes that the change is due to aging of components, rather than to a fault. Thus, a change in power consumption of up to ten per cent, which might be caused over a long period by aging of components, can be accommodated without signalling a fault condition.

Processor 16 is also programmed to compare a predetermined reference value with the delay between operation of one vehicle detector and any one of the other vehicle detectors. Normally, if one of the vehicle detectors detects a vehicle, then one of the other detectors will detect that vehicle within a few seconds or, in a case where the vehicle stops at the junction, within one or two minutes. If there is a delay in excess of several minutes between operation of one vehicle detector and operation of any further vehicle detector, this suggests a fault in the installation and an appropriate alarm signal may be transmitted to the remote station.

Processor 16 is programmed to decide that a fault condition exists in any one of a number of different circumstances, continuous energization of an amber lamp for an excessive period, expiry of an excessive period following detection of a vehicle at one position in the vicinity of the installation, without detection of the vehicle at any other position and a significant increase or decrease in the power consumption value of any single device or group of devices energized concurrently. When processor 16 decides that a fault condition exists, it may transmit an alarm signal to a remote station and may also apply an alarm signal to a local indicator. Processor 16 may be programmed to analyze the fault condition and transmit to the remote station information which identifies a faulty component or a group of components which includes the faulty component. Similarly, an indication which identifies the faulty component or faulty group of components may be provided locally.

The means for transmitting information between processor 16 and the remote station may be suitable for two-way communication. Processor 16 may be interrogated from the remote station to ascertain information relating to the operation and condition of the traffic light system. For example, processor 16 may be arranged to measure each interval between energization and de-energization of amber lamp A1 and may store this information in memory 17 so that information concerning the duration of the last complete cycle of operation of the installation and the duration of the last periods for which individual lamps were energized is available to be transmitted from processor 16 to the remote station.

While the application of the monitoring apparatus of a traffic light system installation has been described, by way of example, the apparatus may additionally or alternatively be used for monitoring the condition of other electrically energized devices. Essentially, if one of the power-measuring means $P_1$–$P_N$ is applied to the power supply of an electrically energizable device, then the condition of that device can be monitored in the manner hereinbefore described. Such monitoring may provide information about the condition of the electrically energizable device itself, for example an electric motor, and/or may provide information about the condition of the apparatus which is driven by the electrically energizable device.

The present invention may be applied to the monitoring of devices other than electrically energizable devices. There may be measured the rate at which energy is absorbed by or is delivered by a device, values representing an input to the device being provided and the measurement being adjusted to compensate for any variation of the input from a reference value, before the measured rate is verified. For example, in the case of an engine having a positive pressure lubrication system including a pump which is driven at a speed directly related to the engine speed, the output pressure of the lubrication pump at each of a number of different engine speeds may be stored, in a table corresponding to engine speeds. Thus, the table can be used subsequently for adjusting measured values.

During normal use of the engine, values representing the engine speed and the lubrication pump output pressure would be provided at intervals. A reference value would initially be determined by multiplying an initial output pressure by a scaler in the table corresponding to an initial engine speed. The stored table of values would then be used to adjust the measured pump output pressure, in order to compensate for the divergence in pressure between different measured engine speeds. The measured pressure values would be adjusted by multiplying them by the scaler in the table corresponding to the measured engine speed. The adjusted pump output pressure would then be compared with the reference value. A substantial departure of the adjusted pump output pressure from the reference value would indicate the onset of a fault condition, for example deterioration of a bearing, deterioration of the lubricant or of the lubrication system itself.

To use apparatus represented in FIG. 2 for monitoring the lubrication system of an engine, transducers would be used to provide electrical signals representing the engine speed and lubrication pump output pressure respectively. These electrical signals, in digital form, would then be processed by processor 16 in the manner hereinbefore described.

In a case where the apparatus is used for monitoring the output pressure for a lubrication pump, processor 16 may be programmed to compute the ratio between a measured value of the output pressure and a reference value, to store the computed ratio and, when the output pressure is again measured, to obtain the corresponding ratio and compare the computed ratio with the stored ratio. If the difference exceeds a predetermined proportion, then processor 16 would take steps appropriate to a fault condition. If the difference is below a predetermined proportion, then processor 16 would assume that the change is due to aging of components, rather than to a fault. Thus, a gradual change in the adjusted value of the pump output pressure may be accommodated without signalling a fault condition.

This concludes the description of the preferred embodiments. A reading by those skilled in the art will bring to mind various changes without departing from the spirit and scope of the invention. It is intended, however, that the invention only be limited by the following appended claims.

What is claimed is:

1. An apparatus for monitoring power or current consumption of one or more electronic devices, the apparatus comprising:

means for providing a plurality of scalers corresponding to a signature of at least one of a power or current consumption of the one or more electronic devices at various voltage levels during operation;

means for periodically sampling voltage levels applied to said one or more electronic devices at selected time intervals;

means for sampling power or current consumption values representing power or current consumed by said one or more electronic devices at said selected time intervals;

means for adjusting said sampled power or current consumption values with said scalers; and means for providing an indication when one of said adjusted power or current consumption values varies from another of said adjusted power or current consumption values by more than a predetermined amount.

2. The apparatus as recited in claim 1 wherein said adjusting means adjusts said sample power or current consumption value with said scaler corresponding to the sample voltage level.

3. The apparatus as recited in claim 2 wherein said scalers correspond to a signature of said devices' power or current consumption at various temperature levels during operation; and whereas said adjusting means adjusts said sample power or current consumption with said scaler corresponding to the devices'temperature level during operation.

4. A method for monitoring parameters of one or more electronic devices, the method comprising the steps of:

determining a signature of at least one of said electronic devices, said signature including electrical parameters of said device while in a known operating condition;

storing said signature as values in a memory for recall during subsequent operation of said device;

detecting said electrical parameters of said device at selected time intervals during said device's subsequent operation;

adjusting said detected electrical parameters with an input representative of said signature values; and providing an indication signal when one of said adjusted electrical parameters detected at one of said selected time intervals exceeds another of said adjusted electrical parameters detected at another of said selected time intervals.

5. The method as recited in claim 4 wherein said electrical device is a traffic light system.

6. The method as recited in claim 4 wherein said electrical parameters includes voltage levels of said device.

7. The method as recited in claim 4 wherein said signature includes a temperature adjacent said device during a known operating condition.

8. A method of monitoring the condition of an electrically energizable device, the method comprising the steps of:

energizing the device by application of different levels of voltage in succession;

measuring the power consumption of the device for each different voltage level;

storing a plurality of scalers which have a predetermined relationship with the power consumption of the device at said different levels of voltage;

measuring, at selected times subsequent to storing the scalers, sample voltage levels applied to the device and sample power consumption values applied to the device;

providing adjusted power consumption values for the device by modifying the sample power consumption values of the device with a corresponding one of the scalers;

comparing one adjusted power consumption value with another adjusted power consumption value; and providing a signal when one adjusted power consumption value of the device varies by a predetermined amount greater than another adjusted power consumption value.

9. The method as recited in claim 8 further comprising the step of providing a adjusted power consumption value by modifying a sample power consumption value of the device with a scaler related to a sample voltage level.

10. The method as recited in claim 8 further comprising the step of providing values representing the power consumption of the device continuously during a period of use of the device, and reading said power consumption values at the selected times.

11. The method as recited in claim 8 wherein the values representing respective applied voltage levels are root mean square values.

12. The method as recited in claim 8 further comprising the steps of providing for each of several other devices, values representing sample power consumption values and applied voltage levels for the other devices; and using the stored scalers for the device to adjust the sample power consumption values of the other devices.

13. The method as recited in claim 12 comprising the step of changing a voltage level applied to each device cyclically.

14. The method as recited in claim 13 wherein the changes in the voltage level applied to the devices include electrical energization of the devices and de-energization thereof.

15. The method as recited in claim 13 further comprising the step of monitoring the interval between the changes in voltage levels of the device.

16. The method as recited in claim 14 wherein the devices include red, amber and green traffic lights, and further comprises the steps of monitoring the intervals between energizing and deenergizing of the amber light.

17. The method as recited in claim 16 wherein the intervals between energization and de-energization of at least one of the amber traffic lights are compared with pre-selected values.

18. The method as recited in claim 8 further comprising the step of computing each scaler by dividing the power consumption at one level of voltage by the power consumption at another level of voltage.

19. An apparatus for monitoring the electrical power consumption of a device, the apparatus comprising:

voltage measuring means for detecting a plurality of different voltage levels, each different voltage level representing a voltage applied to the device during known operating conditions;

power measuring means for providing initial power consumption values, each initial power consumption value corresponding to a power consumption at each of the different voltage levels;

a memory for storing a table of scalers, each scaler corresponding to a ratio between the initial power consumption at each of the different voltage levels and the initial power consumption at a selected one of the different voltage levels;

voltage measuring means for detecting a sample voltage corresponding to a voltage level applied to the device at selected time intervals;

power measuring means for detecting a sample power consumption value corresponding to a power consumption of the device at each of the sample voltage levels at the selected time intervals;

a processor including:

(a) means for adjusting said power consumption values with the scaler corresponding to the voltage level applied to the device at the selected time interval;

(b) means for subtracting the magnitude of one of the adjusted power consumption values from the magnitude of another adjusted power consumption value; and (c) means for providing a signal indicating that one adjusted power consumption value differs from another adjusted power consumption value.

20. The apparatus as recited in claim 18 wherein respective power measuring means are coupled to the device to be monitored.

* * * * *